US009157346B2

(12) United States Patent
Kim

(10) Patent No.: US 9,157,346 B2
(45) Date of Patent: Oct. 13, 2015

(54) 2-STEP VARIABLE VALVE LIFT APPARATUS ACTUATED BY DUAL ROLLER BEARINGS USING ELECTROMAGNETIC SYSTEM

(71) Applicant: Hyundai Motor Company, Seoul (KR)

(72) Inventor: Sangyun Kim, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/253,673

(22) Filed: Apr. 15, 2014

(65) Prior Publication Data

US 2015/0167511 A1 Jun. 18, 2015

(30) Foreign Application Priority Data

Dec. 12, 2013 (KR) ..... 10-2013-0154964

(51) Int. Cl.
*F01L 1/34* (2006.01)
*F01L 13/00* (2006.01)

(52) U.S. Cl.
CPC ..... *F01L 13/0036* (2013.01)

(58) Field of Classification Search
CPC ..... F01L 1/18; F01L 1/185; F01L 13/0036
USPC ..... 123/90.16
See application file for complete search history.

(56) References Cited

U.S. PATENT DOCUMENTS

| | | | | |
|---|---|---|---|---|
| 7,205,686 | B2 * | 4/2007 | Okubo | 310/15 |
| 2009/0095241 | A1 * | 4/2009 | Ihlemann | 123/90.16 |

FOREIGN PATENT DOCUMENTS

| | | | |
|---|---|---|---|
| JP | 5-44410 | A | 2/1993 |
| JP | 2007-56777 | A | 3/2007 |
| JP | 2011-226331 | A | 11/2011 |
| KR | 10-2009-0043283 | A | 5/2009 |

* cited by examiner

*Primary Examiner* — Zelalem Eshete
(74) *Attorney, Agent, or Firm* — Morgan, Lewis & Bockius LLP

(57) ABSTRACT

A variable valve lift apparatus may include a camshaft, a cam lobe including at least one low lift cam and at least one high lift cam, and formed or mounted on an exterior circumference of the camshaft, and a cam follower opening a valve with a low lift or a high lift or closing the valve by a rotation of the camshaft. The cam follower may include a valve lift body pivoting on one side and opening or closing the valve by the cam lobe when the camshaft rotates, a bearing shaft fixedly mounted in the valve lift body, and at least one rolling bearing rotatably mounted on the bearing shaft and being movable axially on the bearing shaft to make contact selectively with the low lift cam or the high lift cam.

19 Claims, 8 Drawing Sheets

FIG. 3A
(Prior Art)
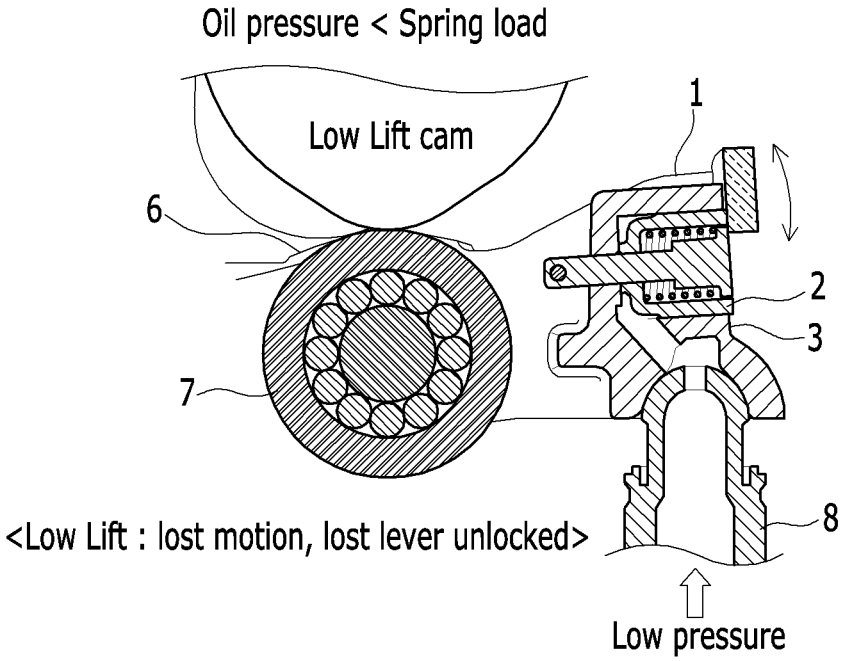
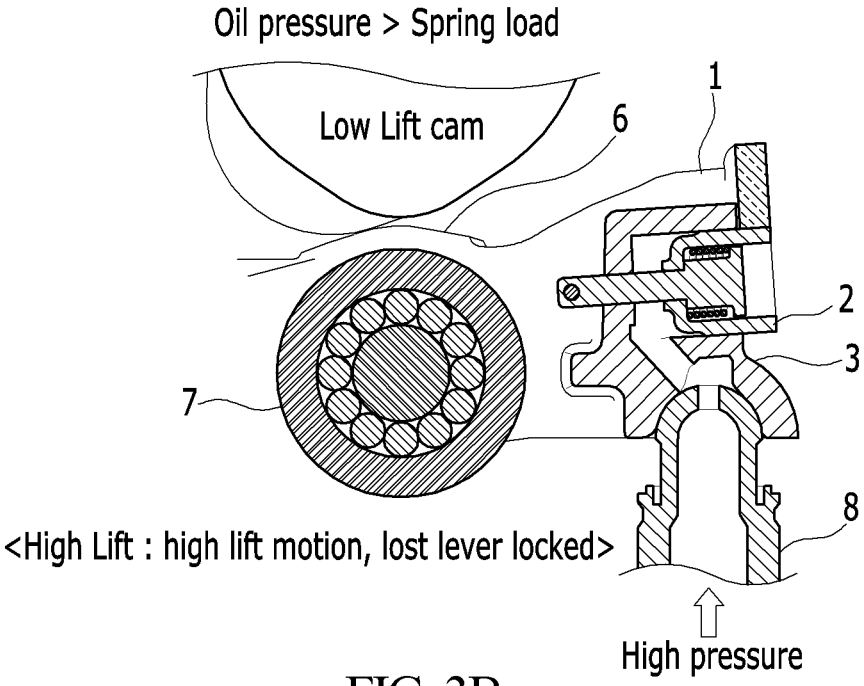
FIG. 3B
(Prior Art)

2-STEP VARIABLE VALVE LIFT APPARATUS ACTUATED BY DUAL ROLLER BEARINGS USING ELECTROMAGNETIC SYSTEM

CROSS-REFERENCE TO RELATED APPLICATION

The present application claims priority of Korean Patent Application Number 10-2013-0154964 filed on Dec. 12, 2013, the entire contents of which application are incorporated herein for all purposes by this reference.

BACKGROUND OF INVENTION

1. Field of Invention

The present invention relates to a variable valve lift apparatus, and more particularly, to the variable valve lift apparatus that can achieve the improvement of fuel consumption, rapid and accurate control of valve lift change, weight and cost reduction, and the improvement of dynamic characteristic and durability of valves.

2. Description of Related Art

In general, variable valve lift technology is being researched to improve driving performance and fuel consumption by changing the size of the valve lift according to the driving conditions of an engine.

FIG. 1 through FIG. 3 are drawings which show the structure and the operational principle of a variable valve lift apparatus according to a prior art. FIG. 1 is a perspective view of a cam follower of a variable valve lift apparatus according to a prior art. FIG. 2 is a cross-sectional view along a line I-I of FIG. 1 for explaining the operational principle of a variable valve lift apparatus according to a prior art.

Referring to FIG. 1 and FIG. 2, the cam follower comprises a lost lever 1, a locking pin 2, an inner arm 3, a lost motion spring 4, and a hinging pin 5. The lost lever 1 includes two lost lever pads 6. The lost lever 1 is the external body of the cam follower. By driving force through the rotation of a high lift cam moves the lost lever 1, which is mounted at the outside of the inner arm 3 and connected with the inner arm 3 by the hinging pin 5.

The inner arm 3 includes a bearing shaft and a roller 7. The inner arm 3 is the internal body of the cam follower. Inside the inner arm 3 is the locking pin 2 installed, which can be moved forward by hydraulic lash adjuster 8. The lost motion spring 4 is fixedly mounted between fixing plates of the lost lever 1 and the inner arm 3 and functions as an actuator making the lost lever 1 return to its original position after its motion relative to the inner arm 3.

Hereinafter, the principle of low lift and high lift operation of a variable valve lift apparatus according to a prior art will be explained.

Firstly, the principle of low lift valve operation of the variable valve lift apparatus is as follows.

The roller 7 is generally a rolling bearing and has the function of delivering the driving force through the rotation of a low lift cam to the inner arm 3 through bearing, shaft fixedly installed in the inner arm 3 by making rolling contact with the low lift cam. At the moment, the driving force through the rotation of the low lift cam acts on the roller 7 with a contact portion of the inner arm 3 and the hydraulic lash adjuster 8 functioning as an axis of rotation and thereby the hinging pin 5 descends.

Therefore, in case the low lift cam makes rolling contact with the roller 7, the driving force through the rotation of the low lift cam is delivered to a valve stem 9 connected with the hinging pin 5 of the inner arm 3 and thereby a valve operates in low lift. In this case, a high lift cam spins the lost lever 1 with no effect on a valve. This motion of the lost lever 1 is called lost motion.

The operational principle of the lost motion of the lost lever 1 will be described below. The lost lever pad 6 is not a rolling bearing and is a portion making friction contact with the high lift cam. It has the function of delivering the driving force through the rotation of the high lift cam to the lost lever 1 and making the lost lever 1 rotate on the hinging pin 5. The rotation is the motion relative to the inner arm 3.

If the driving force through the rotation of the high lift cams is applied to the lost lever pads 6 with the locking pin 2 received inside the inner arm 3, the rotation of the lost lever 1 becomes lost motion. That is to say, the rotating motion applies no force to the cam follower and the lost lever 1 comes back to its original position by the elastic force of the lost motion spring 4 (Refer to FIG. 2). In this case, only the driving force through the rotation of the low lift cam is applied to the hinging pin 5 through the roller 7 and thereby a valve operates in low lift.

Next, the principle of high lift valve operation of the variable valve lift apparatus is as follows.

In case the locking pin 2 is moved forward with the increase of the hydraulic pressure by the operation of the hydraulic lash adjuster 8, the rotating motion of the lost lever 1 is locked by the locking pin 2. At this moment, the hinging pin 5 rotates down on a contact portion of the hydraulic lash adjuster 8 by the driving force through the rotation of the high lift cam being applied to the lost lever pads 6. Accordingly, a valve operates in high lift through the valve stem 9 connected with the hinging pin 5.

FIG. 3 is a drawing which compares the principles of low lift valve operation and high lift valve operation of a variable valve lift apparatus according to a prior art. Referring to FIG. 3, foregoing explanations will be organized hereinafter.

In case hydraulic pressure of the hydraulic lash adjuster 8 is lower than the load of a spring supporting the locking pin 2, a variable valve lift apparatus operates in low lift condition. In this case, the rotating motion of the lost lever 1 by a high lift cam becomes lost motion.

This is because the lost lever 1 operates in a state of being unlocked with the locking pin 2 received inside the inner arm 3 on account of the locking pin 2 being supported by the spring. In other words, the high lift cam spins with no effect on a valve while the low lift cam makes rolling contact with the roller 7 and thereby the valve operates in low lift.

In case hydraulic pressure of the hydraulic lash adjuster 8 is higher than the load of the spring supporting the locking pin 2, a variable valve lift apparatus operates in high lift condition. In this case, the locking pin 2 moves forward and protrudes from the inner arm 3 by overcoming the load of the spring through higher hydraulic pressure.

Accordingly, the lost lever 1 becomes in locked condition, the driving force through the rotation of the high lift cams acts on the lost lever pads 6 with a contact portion of the hydraulic lash adjuster 8 functioning as a pivot, and thereby the hinging pin 5 descends and a valve operates in high lift. At this moment, the low lift cam and the roller 7 don't make contact with each other in principle as FIG. 3 shows.

This is because the high lift cams make contact with the lost lever pads 6 on the point of the low lift cam making contact with the roller 7 and the inner arm 3 descends in high lift condition.

The problems of the prior art includes at least the followings.

In high lift condition, the valve lift operation is carried out not through a rolling bearing but through the lost lever pads 6.

As a result, friction loss is large, abrasion happens, and thereby durability of a variable valve lift apparatus is deteriorated.

In low lift condition as well as high lift condition, two high lift cams always make friction contact with the lost lever pads 6. Therefore, friction loss continues while valves keep opening or closing.

In the meantime, even in high lift condition the contact of the low lift cam and the roller 7 may actually happen and thereby the gap between the high lift cams and the lost lever pads 6 may happen.

This is because even though machining is executed so precisely it's almost impossible for the high lift cams and the low lift cam to simultaneously come into contact with the lost lever pads 6 and the roller 7 respectively. This kind of phenomenon may result from defects of machining precision and vibrations of the variable valve lift apparatus, etc.

In case the gap is formed, lift loss happens in high lift condition, impulsive load acts on the valve apparatus, and thereby durability may be deteriorated. In addition, the structure and the shape of a variable valve lift apparatus according to a prior art are complicated and there are lots of parts in it. This becomes the cause of rise of manufacturing cost and exerts a bad effect on dynamic characteristic and durability of the variable valve lift apparatus.

A variable valve lift apparatus according to a prior art operates through oil pressure of oil gallery by controlling an oil control valve (OCV). On this account, the variable valve lift apparatus is sensitive to oil temperature and pressure and an unnecessary demand for increasing a capacity of hydraulic pump may arise.

The information disclosed in this Background of the Invention section is only for enhancement of understanding of the general background of the invention and should not be taken as an acknowledgement or any form of suggestion that this information forms the prior art already known to a person skilled in the art.

SUMMARY OF INVENTION

Various aspects of the present invention are directed to providing a variable valve lift apparatus realizing fast and accurate control of valve lift change by making the valve lift operate and change all the time without frictional contact and using a simple control method of changing a current direction.

In various aspects of the present invention, the variable valve lift apparatus may comprise a camshaft, a cam lobe including at least one low lift cam and at least one high lift cam, the cam lobe formed or mounted on an exterior circumference of the camshaft, and a cam follower opening a valve with a low lift or a high lift or closing the valve by a rotation of the camshaft. The cam follower may comprise a valve lift body pivoting on one side thereof and opening or closing the valve by the cam lobe when the camshaft rotates, a bearing shaft fixedly mounted in the valve lift body, and at least one rolling bearing rotatably mounted on the bearing shaft and being movable axially on the bearing shaft to make contact selectively with the low lift cam or the high lift cam.

The bearing shaft may include an insulated coil. The insulated coil may be mounted in the bearing shaft and generate magnetic force at both ends of the bearing shaft while an electric current flows through the insulated coil.

The rolling bearing may include at least one permanent magnet. The permanent magnet may move the rolling bearing axially on the bearing shaft by interacting with the magnetic force of the bearing shaft and thereby generating attractive force or repulsive force.

The variable valve lift apparatus according to the present invention may further include a connector installed in the valve lift body, and may be such that an electric current can be supplied to the insulated coil by the connector.

Furthermore, the variable valve lift apparatus may include a pair of the rolling bearings, one of the pair of the rolling bearings moving in the opposite direction of the other and the cam lobe may include two low lift cams formed at a middle portion thereof and two high lift cams formed at both ends thereof. The two low lift cams and the two high lift cams may be integrally or monolithically formed. There may be no gaps between the neighboring cams that the cam lobe comprises and all of the low lift cams and the high lift cams may have the same base circle section. The bearing shaft may further include a centered ring which prevents the pair of the rolling bearings from moving to any one side from the center of the bearing shaft.

The variable valve lift apparatus according to the present invention may have the permanent magnet mounted in such a way that attractive force is generated between the pair of the rolling bearings, the pair of the rolling bearings move toward a middle portion of the bearing shaft corresponding to locations of the two low lift cams in a low lift condition, and the pair of the rolling bearings respectively move toward the both ends of the bearing shaft corresponding to locations of the two high lift cams in a high lift condition.

A width of the valve lift body may be configured such that a moving distance of the pair of the rolling bearings is restricted corresponding to locations of the two high lift cams. The pair of the rolling bearings may be adapted to move when they make contact with a base circle section of the cam lobe. The permanent magnet may be of bar type or ring type and the centered ring may be a snap ring or a clip.

The variable valve lift apparatus according to various other aspects of the present invention may include a pair of the rolling bearings, one of the pair of the rolling bearings moving in the opposite direction of the other and the cam lobe may include two high lift cams formed at a middle portion thereof and two low lift cams in both ends thereof. The two low lift cams and the two high lift cams may be integrally formed. There may be no gap between the neighboring cams that the cam lobe comprises and all of the low lift cams and the high lift cams may have the same base circle. The bearing shaft may further include a centered ring which prevents the pair of the rolling bearings from moving to any one side from the center of the bearing shaft.

The variable valve lift apparatus according to the present invention may have the permanent magnet mounted in such a way that repulsive force is generated between the pair of the rolling bearings, the pair of the rolling bearings respectively move toward the both ends of the bearing shaft corresponding to locations of the two low lift cams in a low lift condition, and the pair of the rolling bearings move toward a middle portion of the bearing shaft corresponding to locations of the two high lift cams in a high lift condition.

A width of the valve lift body may be configured such that a moving distance of the pair of the rolling bearings is restricted corresponding to locations of the two low lift cams. The pair of the rolling bearings may be adapted to move when they make contact with a base circle section of the cam lobe. The permanent magnet may be of bar type or ring type and the centered ring may be a snap ring or a clip.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 3A and FIG. 3B are drawings which compare the principles of low lift valve operation and high lift valve operation of a variable valve lift apparatus according to a prior art.

Figure 1:
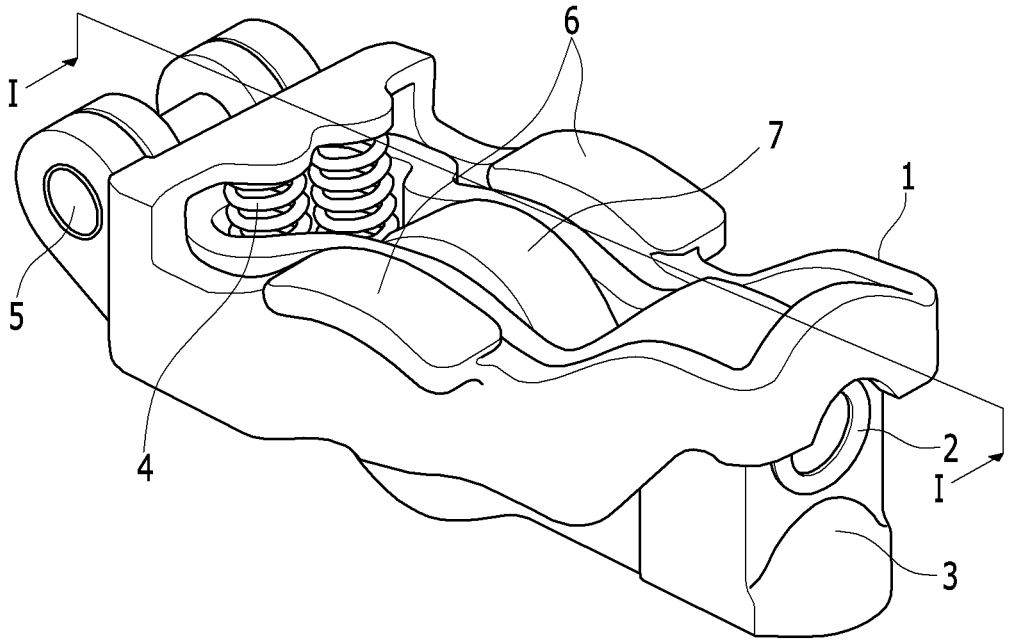
FIG. 1 (Prior Art)
FIG. 1 is a perspective view of a cam follower of a variable valve lift apparatus according to a prior art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

In addition, unless explicitly described to the contrary, the word "comprise" and variations such as "comprises" or "comprising" will be understood to imply the inclusion of stated elements but not the exclusion of any other elements and the name of a component doesn't set limits to the function of the component concerned.

Figure 4:
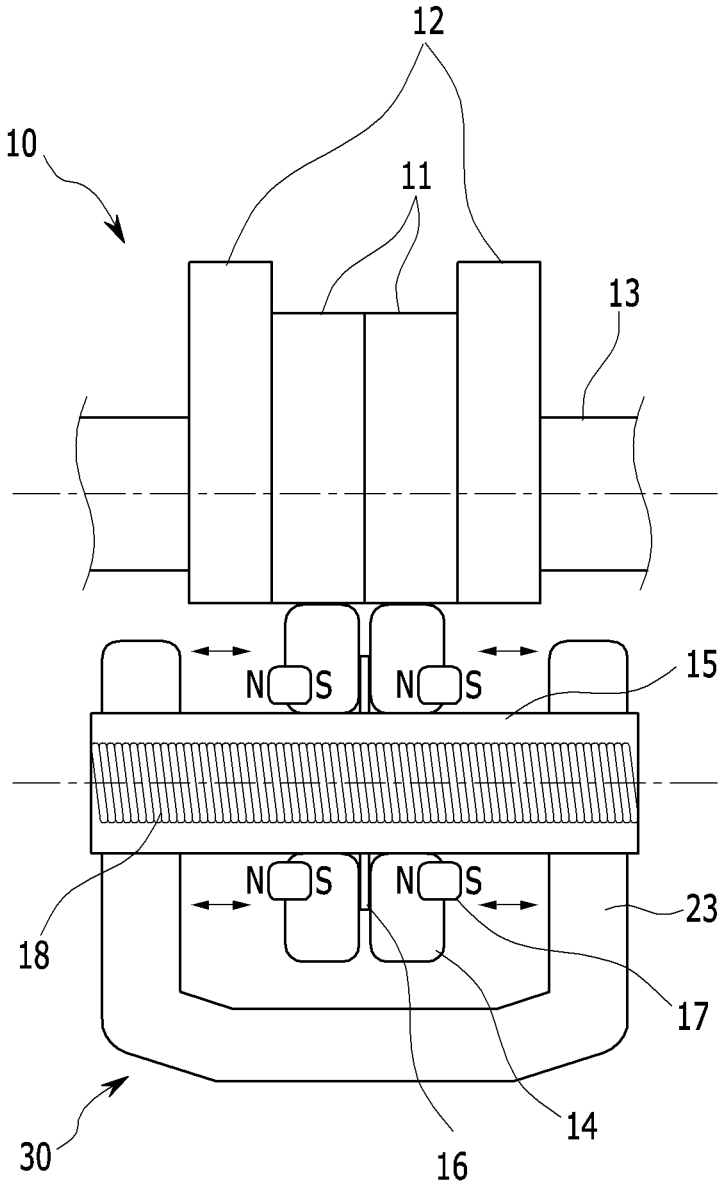
FIG. 4 is a drawing which shows the structure and the operational principle of an exemplary variable valve lift apparatus according to the present invention.
Figure 5:
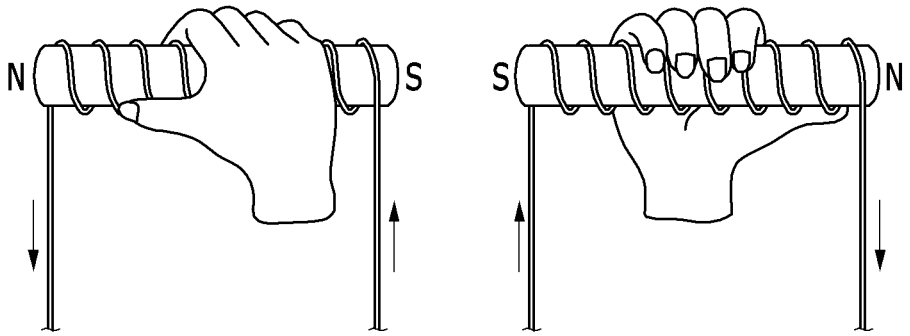
FIG. 5 is a drawing which shows Ampere's right-handed screw rule which is the principle of an electromagnet.
Figure 6:
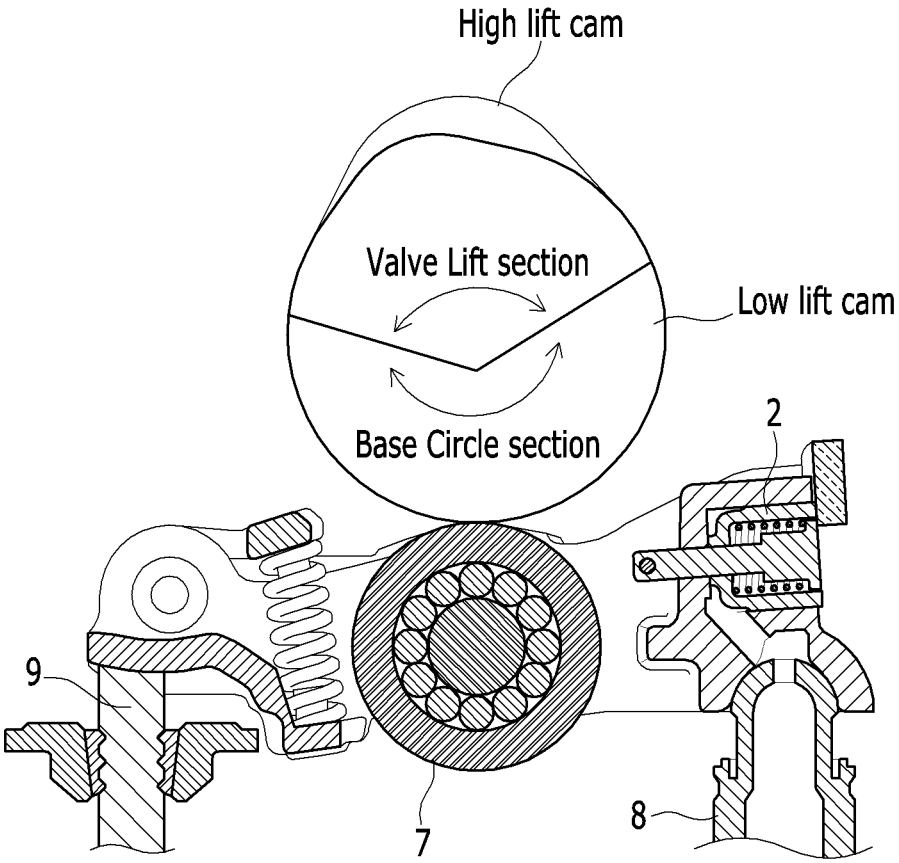
FIG. 6 is a drawing which shows a valve lift section of an exemplary cam lobe.
Figure 7A:
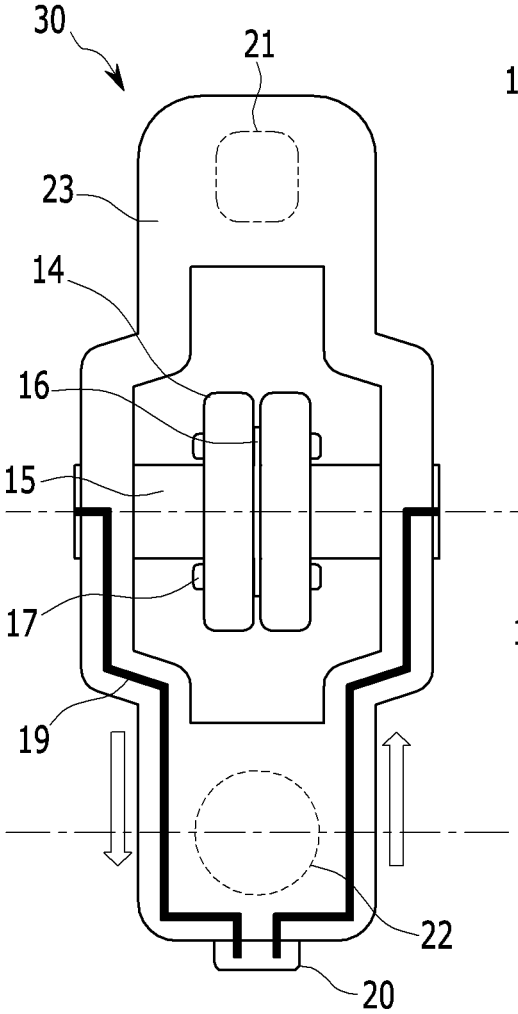
FIGS. 7A and 7B are drawings which show the low lift condition of an exemplary variable valve lift apparatus according to the present invention.
Figure 7B:
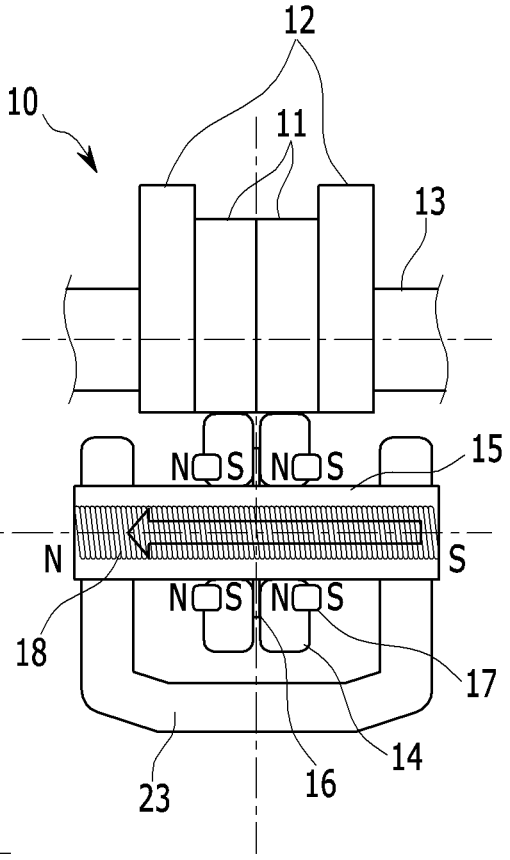
Figure 8A:
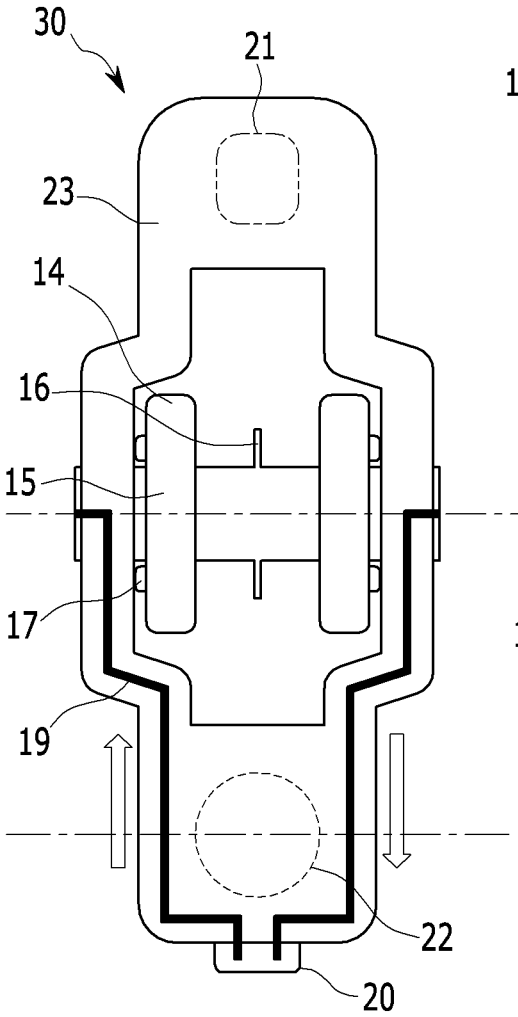
FIGS. 8A and 8B are drawings which show the high lift condition of an exemplary variable valve lift apparatus according to the present invention.
Figure 8B:
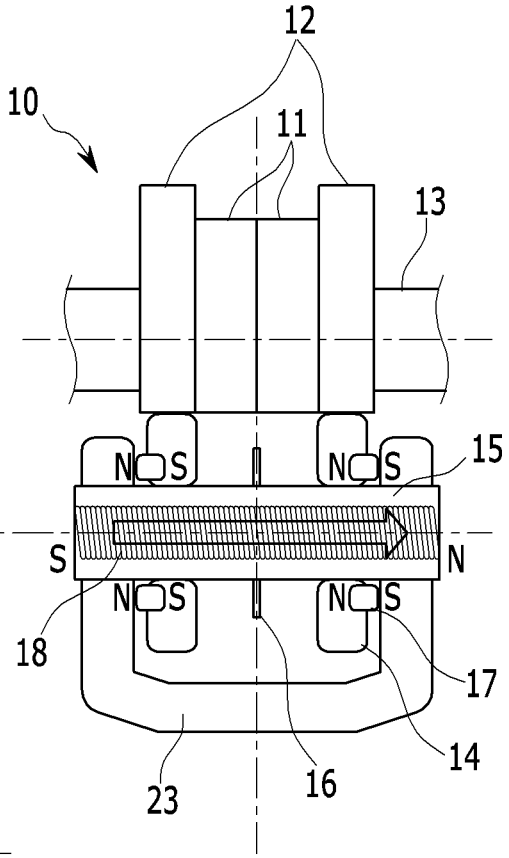

FIG. 4 through FIG. 6 are drawings which show the structure and the operational principle of a variable valve lift apparatus, FIGS. 7A and 7B are drawings which show the low lift condition of a variable valve lift apparatus, and FIGS. 8A and 8B are drawings which show the high lift condition of a variable valve lift apparatus, according to various embodiments of the present invention.

Referring to FIG. 4 and FIG. 7A, a variable valve lift apparatus according to various embodiments of the present invention may comprise a cam lobe 10, a camshaft 13, a cam follower 30 and 2-pin connector 20.

The cam lobe 10 may include at least one low lift cam 11 and at least one high lift cam 12 and be formed or mounted on the camshaft 13. As an exemplary embodiment, the cam lobe 10 have two low lift cams 11 and two high lift cams 12 in FIG. 4. The low lift cams 11 and the high lift cams 12 may be integrally or monolithically formed as a body, but they are not limited to that kind of structure. In other words, the low lift cams 11 and the high lift cams 12 may be produced separately and assembled next to each other on the camshaft 13. In addition, there may be no gap between the neighboring cams that the cam lobe 10 comprises and all of the low lift cams 11 and the high lift cams 12 may have the same base circle or the same base circle section.

As for a base circle, it is a portion forming a circular arc in the curved line making the profile of the cam lobe 10. While a base circle section of the cam lobe 10 makes contact with the cam follower 30, a valve is not opened. Herein, a base circle section means a section in which the base circle and the profile of the cam lobe 10 are identical with each other (See also FIG. 6).

The cam lobe 10 according to various embodiments of the present invention may be such that two low lift cams 11 and two high lift cams 12 are respectively disposed in the middle portion or in both ends of the cam lobe 10. The camshaft 13 is connected with an engine crankshaft, and thereby delivers the driving force of rotation to the cam lobe 10.

Figure 2:
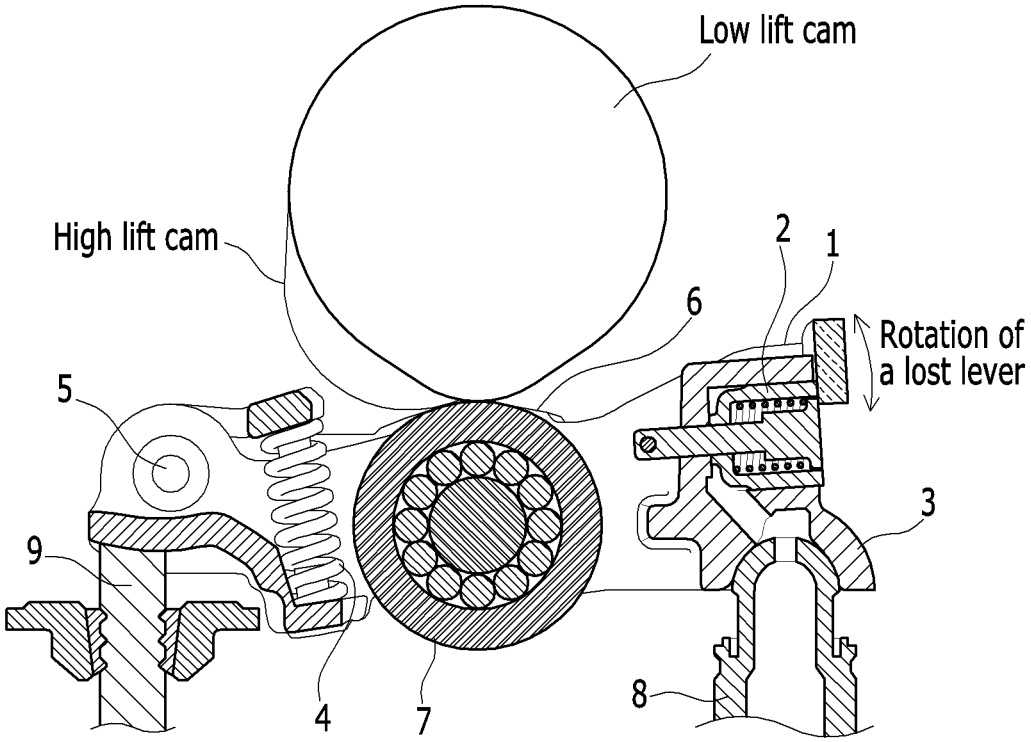
FIG. 2 (Prior Art)
FIG. 2 is a cross-sectional view along a line I-I of FIG. 1 for explaining the operational principle of a variable valve lift apparatus according to a prior art.

The cam follower 30 may comprise a valve lift body 23, at least one rolling bearing 14 and a bearing shaft 15 or further include a centered ring 16 with those three components. The valve lift body 23 is the linkage which delivers the driving force through the rotation of the cam lobe 10 to a valve stem (Refer to FIG. 2), and thereby opens or closes the valve.

A valve stem connection portion 21 and a hydraulic lash adjuster contact portion 22 may be formed in the both ends of the valve lift body 23 along its length (Refer to FIG. 7A). The valve stem connection portion 21 may turn on the hydraulic lash adjuster contact portion 22, and thereby a valve may be opened or closed.

The bearing shaft 15 may be mounted in the width direction of the valve lift body 23. An insulated coil 18 may be mounted in the bearing shaft 15. The bearing shaft 15 may be fixedly mounted in the valve lift body 23 by being forcibly inserted or welded. The bearing shaft 15 changes the driving force through the rotation of the cam lobe 10 into the turning motion of the valve lift body 23. The external surface of the bearing shaft 15 may be treated by heating or coating in order to reduce frictional resistance and abrasion in motion of a rolling bearing in the axial direction.

The insulated coil 18 may include a coil connection line 19. The insulated coil 18 may be installed by being spirally wound around a circularly cylindrical rod which is made of nonconductive materials like plastics and thereafter the rod being installed inside the bearing shaft 15 or may be fixedly mounted by thin, hollow, and cylindrical rod being inserted around the bearing shaft 15 after the insulated coil 18 being spirally wound around the external surface of the bearing shaft 15.

The insulated coil 18 generates magnetic force of an N pole and an S pole respectively at both ends of the bearing shaft 15 by magnetizing the bearing shaft 15 while an electric current flows through the coil connection line 19 connected to the insulated coil 18.

The rolling bearing 14 may include at least one permanent magnet 17. A pair of the rolling bearings 14 may be rotatably installed on the bearing shaft 15. The pair of the rolling bearings 14 delivers the driving force through the rotation of the cam lobe 10 to the bearing shaft 15 by making rolling contact with the cam lobe 10. In addition, each rolling bearing 14 may be installed such that it is able to move freely in the axial direction of the bearing shaft 15.

Each of the permanent magnet 17 may be fixedly mounted in the rolling bearing 14 and causes attractive force or repulsive force between the rolling bearing 14 and the both ends of the bearing shaft 15 by interacting with the magnetic force of the bearing shaft 15. Furthermore, each of the permanent magnet 17 may also cause attractive force or repulsive force between the pair of the rolling bearings 14.

Each of the permanent magnet 17 may be fixedly mounted in the inside portion, which is not rotating, of the rolling bearing 14 in order to interact effectively with the magnetic force of the bearing shaft 15 and in order for the repulsive force or the attractive force to act properly between the pair of the rolling bearings 14.

The method of forcibly inserting or bolting the permanent magnet 17 to the rolling bearing 14 is possible as the mounting method mentioned above. In this case, the permanent magnets 17 being mounted may be a bar magnet. In FIGS. 7A, 7B, 8A and 8B, an exemplary embodiment in which bar magnets are mounted has been presented.

Besides a bar type permanent magnet, a ring type permanent magnet may be fixedly mounted in the inside non-rotating portion of the rolling bearing 14, which is the portion being combined with the bearing shaft 15. In case a ring type permanent magnet is utilized, it may be mounted also in the rotating portion of the rolling bearings 14. This is because even though a ring type permanent magnet rotates with the rolling bearing 14 the direction or the position of magnetic force are not changed. In case of using a ring type permanent magnet, the installing method of bonding may be further added.

The centered ring 16 may further be mounted in the central portion of the bearing shaft 15 and has the function of preventing the rolling bearings 14 from moving to any one side from the center of the bearing shaft 15. The centered ring 16 may be a snap ring or a clip commonly used.

The 2-pin connector 20 is installed for connecting the coil connection line 19 and a control unit. The control unit may be an engine control unit (ECU). By the 2-pin connector 20, a direct current which is controlled by the control unit can be supplied to the insulated coil 18.

Until now, the structure of the variable valve lift apparatus according to various embodiments of the present invention has been described. The operational principle of the variable valve lift apparatus of various embodiments of the present invention will be explained as follows.

FIG. 5 shows Ampere's right-handed screw rule which is the principle of an electromagnet. In case an electric current flows through a circular coil, a magnetic field is generated in the advancing direction of a screw. Therefore, the direction which is pointed with a thumb when right hand fingers close around the direction of an electric current flowing through the circular coil becomes an N-pole.

Referring to FIG. 4, attractive force or repulsive force is caused by the interaction of the magnetic force which is generated around the bearing shaft 15 by an electric current flowing through the insulated coil 18 and the N-pole and the S-pole of the permanent magnet(s) 17 installed in the rolling bearing 14, and thereby the rolling bearings 14 can move in the axial direction along the bearing shaft 15.

In more detail, in case an electric current flows through the insulated coil 18 from the right side to the left side such that the left side of the bearing shaft 15 becomes the N-pole and the right side of it becomes the S-pole, the pair of the rolling bearings 14 are gotten together in the middle of the bearing shaft 15. This is because in case the N-pole and the S-pole of the permanent magnets 17 are disposed as in FIG. 4, the repulsive force acts respectively between the pair of the rolling bearings 14 and the ends of the bearing shaft 15. This situation is shown in FIG. 7B.

In contrast, in case an electric current flows through the insulated coil 18 from the left side to the right side such that the left side of the bearing shaft 15 becomes the S-pole and the right side of it becomes the N-pole, the pair of the rolling bearings 14 respectively move to the both sides of the bearing shaft 15. This is because in this case the attractive force acts respectively between the pair of the rolling bearings 14 and the ends of the bearing shaft 15. This situation is shown in FIG. 8B.

FIG. 6 shows a valve lift section of a cam lobe. In a base circle section, minimal surface pressure only acts between a rolling bearing 7 and a cam lobe. This is because in this section the profile of the cam lobe and the base circle are identical or substantially identical. In this section, a valve is not lifted and only the rolling contact between the cam lobe and the rolling bearing 7 is generated.

In comparison, a valve lift section is a section in which the profile of the cam lobe in this section is different from the base circle and the radius of curvature is larger than that of the base circle. In case the contact portion of the cam lobe and the rolling bearing 7 enters the valve lift section, the surface pressure acting on the rolling bearing 7 increases, and thereby the valve is lifted. The valve lift section is related to the movement timing of a rolling bearing 14 according to various embodiments of the present invention.

An ECU can accurately recognize an angular position of a cam lobe in each combustion chamber through sensing the engine timing made by a crankshaft. Accordingly, in case the change of the valve lift is needed, the ECU moves the rolling bearing 14 according to various embodiments of the present invention in the axial direction of the bearing shaft 15 by altering the direction of an electric current flowing through the insulated coil 18 precisely when in each chamber the angular position of the cam lobe 10 passes the valve lift section and enters the base circle section. So, the rolling bearing 14 can make rolling contact selectively with high lift cam or low lift cam of the cam lobe 10.

This is also because in the base circle section a clearance can be allowed which enables the rolling bearing 14 to move freely on the bearing shaft 15 as well as minimal surface pressure only acts between the rolling bearing 14 and the cam lobe 10. The clearance means the gap between the cam lobe 10 and the rolling bearing 14.

The principle of low lift valve operation of the variable valve lift apparatus according to various embodiments of the present invention is as follows (FIG. 7).

In case the direction of an electric current flowing through the insulated coil 18 is from the right side to the left side, the magnetic force is generated in which the left side of the bearing shaft 15 becomes the N-pole and the right side of it becomes the S-pole (FIG. 7B). In this case, the direction of an electric current flowing through the coil connection line 19 is as in FIG. 7A. Accordingly, the N-pole of the bearing shaft 15 and the N-pole of the permanent magnet 17 in the left side and the S-pole of the bearing shaft 15 and the S-pole of the permanent magnet 17 in the right side generate repulsive force respectively therebetween.

The pair of rolling bearings 14 which are respectively repelled by the repulsive force become to meet together in the middle or middle portion of the bearing shaft 15. At this moment, if a centered ring 16 exists the pair of rolling bearings 14 can be positioned accurately in the middle so that they don't move to any one side from the center portion and perfectly make rolling contact with the low lift cams 11 of the cam lobe 10 in the intended positions.

As the pair of rolling bearings 14 disposed in the accurate positions are driven in accordance with the profile of the low lift cams 11 of the cam lobe 10, the variable valve lift apparatus of various embodiments of the present invention becomes to operate in low lift condition.

As explained in the previous part of explaining the structure of the variable valve lift apparatus of various embodiments of the present invention, the valve operates in low lift condition by the valve stem connection portion 21 turning on the hydraulic lash adjuster contact portion 22 since the driving force through the rotation of the low lift cams 11 is delivered to the valve lift body 23 by the rolling bearings 14.

Even if the ignition of an engine is turned off or the insulated coil 18 or the coil connection line 19, etc. is disconnected, attractive force by the opposite polarity of the permanent magnets 17 making a pair with each other gets the rolling bearings 14 together in the middle or middle portion of the bearing shaft 15. As a result, valves basically operate in low lift condition as long as the electric current doesn't flow reversely.

The principle of high lift valve operation of the variable valve lift apparatus according to various embodiments of the present invention is as follows (FIG. 8).

In case the direction of an electric current flowing through the insulated coil 18 is from the left side to the right side, the magnetic force is generated in which the left side of the bearing shaft 15 becomes the S-pole and the right side of it becomes the N-pole (FIG. 8B). In this case, the direction of an electric current flowing through the coil connection line 19 is as in FIG. 8A. Accordingly, the S-pole of the bearing shaft 15 and the N-pole of the permanent magnet 17 in the left side and the N-pole of the bearing shaft 15 and the S-pole of the permanent magnet 17 in the right side generate attractive force respectively therebetween.

The pair of rolling bearings 14 which are respectively attracted by the attractive force become to move toward the both ends of the bearing shaft 15. They may move to the both ends of the bearing shaft 15. In this case, the valve lift body 23 may be formed to have such a width that maximum moving distance of the pair of rolling bearings 14 is restricted so as to be accurately positioned correspondingly to the locations of the high lift cams 12 of the cam lobe 10 (FIG. 8B).

As the pair of rolling bearings 14 disposed in the accurate positions are driven in accordance with the profile of the high lift cams 12 of the cam lobe 10, the variable valve lift apparatus of various embodiments of the present invention becomes to operate in high lift condition.

As in foregoing explanation of low lift condition, the valve operates in high lift condition by the valve stem connection portion 21 turning on the hydraulic lash adjuster contact portion 22 since the driving force through the rotation of the high lift cams 12 is delivered to the valve lift body 23 by the rolling bearings 14.

Like this, the variable valve lift apparatus of various embodiments of the present invention has various benefits of having less parts and the simpler structure than a prior art, improving in durability because there exists a small amount of friction by realizing the valve lifting operation with only rolling contact all the time, and obtaining the controllability of changing valve lifts and the rapidity of response thereof, etc.

As stated in detail above, distinctive effects according to the present invention include at least the followings.

Firstly, the improvement of fuel consumption is achieved through reducing friction. This is because the two lost lever pads 6 which make friction contact with the high lift cams 12 all the time are removed. The effect of the reduction of friction is large compared with a prior art because driving the valve lifts not by friction contact but by rolling contact is realized in high lift condition as well as low lift condition.

Secondly, rapid and accurate control of the change in valve lifts using an electromagnet is achieved. Because oil pressure is not used which should be altered at the right time according to variations of oil temperature and engine RPM, an oil control valve (OCV) is dispensable in various embodiments of the present invention. It's because the direction of an electric current is controlled at nearly the speed of light that the change of the valve lift conditions is fast and exact.

Thirdly, weight and cost are reduced. The structure and the shape of the variable valve lift apparatus are simple and component parts thereof are fewer. By this effect, material cost and processing cost are reduced and the reduction of the weight and cost is maximized on account of removing an OCV and downsizing the capacity of an oil pump system.

Fourthly, the improvement of dynamic properties and durability is achieved. It is because weight is reduced and the center of gravity of the variable valve lift apparatus can be positioned near to hydraulic lash adjuster contact portion 22.

In an exemplary embodiment, the apparatus is driven through two rolling bearings 14, a gap like that between the high lift cams and the lost lever pads 6 in high lift condition of a prior art isn't generated because the rolling bearings 14 make rolling contact only with the cams which determine a present valve lift condition, namely high lift or low lift condition, and thereby lift loss is prevented.

By this effect, impulsive load can be removed and valve durability can also be largely improved. In addition, the structure and the shape of the apparatus are very simple, and thereby the present invention is advantageous also in the aspect of unit piece durability.

For convenience in explanation and accurate definition in the appended claims, the terms "left" or "right", "inner" or "outer", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus comprising:

a camshaft;

a cam lobe including at least one low lift cam and at least one high lift cam, the cam lobe formed or mounted on an exterior circumference of the camshaft; and a cam follower opening a valve with a low lift or a high lift or closing the valve by a rotation of the camshaft, wherein the cam follower comprises:

a valve lift body pivoting on one side thereof and opening or closing the valve by the cam lobe when the camshaft rotates;

a bearing shaft fixedly mounted in the valve lift body wherein the bearing shaft comprises an insulated coil mounted in the bearing shaft and the insulated coil generates magnetic force at both ends of the bearing shaft while an electric current flows through the insulated coil; and at least one rolling bearing including a permanent magnet rotatably mounted on the bearing shaft and being movable axially on the bearing shaft according to the magnetic force of the insulated coil to make contact selectively with the low lift cam or the high lift cam.

2. The variable valve lift apparatus of claim 1, wherein the permanent magnet causes the at least one rolling bearing to move axially on the bearing shaft by generating attractive force or repulsive force according to interaction with the magnetic force of the bearing shaft.

3. The variable valve lift apparatus of claim 1, further comprising a connector supplying the electric current to the insulated coil and installed in the valve lift body.

4. The variable valve lift apparatus of claim 2, wherein a pair of rolling bearings are included, one of the pair of the rolling bearings moving in an opposite direction of the other, and wherein the cam lobe includes two low lift cams formed at a middle portion thereof and two high lift cams formed at both ends thereof.

5. The variable valve lift apparatus of claim 4, wherein the two low lift cams and the two high lift cams are integrally formed.

6. The variable valve lift apparatus of claim 4, wherein neighboring cams make close contact with each other without a gap therebetween and all of the low lift cams and the high lift cams have a same base circle section.

7. The variable valve lift apparatus of claim 4, wherein the bearing shaft further includes a centered ring which prevents the pair of the rolling bearings from moving to any one side from a center of the bearing shaft.

8. The variable valve lift apparatus of claim 4, wherein the permanent magnet of each rolling bearing is mounted such that attractive force is generated between the pair of the rolling bearings, and wherein the pair of the rolling bearings move toward a middle portion of the bearing shaft corresponding to locations of the two low lift cams in a low lift condition, and the pair of the rolling bearings respectively move toward the both ends of the bearing shaft corresponding to locations of the two high lift cams in a high lift condition.

9. The variable valve lift apparatus of claim 4, wherein a width of the valve lift body is configured such that a moving distance of the pair of the rolling bearings is restricted corresponding to locations of the two high lift cams.

10. The variable valve lift apparatus of claim 6, wherein the pair of the rolling bearings are adapted to move when making contact with the base circle section of the cam lobe.

11. The variable valve lift apparatus of claim 4, wherein the permanent magnet is of bar type or ring type.

12. The variable valve lift apparatus of claim 7, wherein the centered ring is a snap ring or a clip.

13. The variable valve lift apparatus of claim 2, wherein a pair of the rolling bearings are included, one of the pair of the rolling bearings moving in an opposite direction of the other, and wherein the cam lobe includes two high lift cams formed at a middle portion thereof and two low lift cams formed at both ends thereof.

14. The variable valve lift apparatus of claim 13, wherein the two low lift cams and the two high lift cams are integrally formed.

15. The variable valve lift apparatus of claim 13, wherein neighboring cams make close contact with each other without a gap therebetween and all of the low lift cams and the high lift cams have a same base circle section.

16. The variable valve lift apparatus of claim 13, wherein the bearing shaft further includes a centered ring which prevents the pair of the rolling bearings from moving to any one side from a center of the bearing shaft.

17. The variable valve lift apparatus of claim 13, wherein the permanent magnet of each rolling bearing is mounted such that repulsive force is generated between the pair of the rolling bearings, and wherein the pair of the rolling bearings respectively move toward the both ends of the bearing shaft corresponding to locations of the two low lift cams in a low lift condition, and the pair of the rolling bearings move toward a middle portion of the bearing shaft corresponding to locations of the two high lift cams in a high lift condition.

18. The variable valve lift apparatus of claim 13, wherein a width of the valve lift body is configured such that a moving distance of the pair of the rolling bearings is restricted corresponding to locations of the two low lift cams.

19. The variable valve lift apparatus of claim 15, wherein the pair of the rolling bearings are adapted to move when making contact with the base circle section of the cam lobe.

* * * * *